US008726546B2

(12) United States Patent
Hopper

(10) Patent No.: US 8,726,546 B2
(45) Date of Patent: May 20, 2014

(54) MEDAL MOUNTING APPARATUS

(76) Inventor: Gregory James Hopper, Auchenflower (AU)

( * ) Notice: Subject to any disclaimer, the term of this patent is extended or adjusted under 35 U.S.C. 154(b) by 0 days.

(21) Appl. No.: 13/883,296

(22) PCT Filed: Nov. 4, 2011

(86) PCT No.: PCT/AU2011/001418

§ 371 (c)(1),
(2), (4) Date: May 3, 2013

(87) PCT Pub. No.: WO2012/058728

PCT Pub. Date: May 10, 2012

(65) Prior Publication Data

US 2013/0326920 A1 Dec. 12, 2013

(30) Foreign Application Priority Data

Nov. 5, 2010 (AU) ..... 2010904920

(51) Int. Cl.
*A44C 3/00* (2006.01)

(52) U.S. Cl.
USPC ..... 40/1.5; 40/586; 40/653; 33/653

(58) Field of Classification Search
USPC ..... 40/1.5, 1.6, 657, 586; 33/653, 645
See application file for complete search history.

(56) References Cited

U.S. PATENT DOCUMENTS

| | | | | |
|---|---|---|---|---|
| 2,834,129 | A * | 5/1958 | Kirkbride | 40/1.5 |
| 5,782,022 | A * | 7/1998 | Tubberville | 40/1.6 |
| 5,791,076 | A * | 8/1998 | Gailliard | 40/1.5 |
| 6,328,171 | B1 | 12/2001 | Coppel | |
| 6,622,405 | B1 | 9/2003 | Perrone | |
| 8,356,433 | B2 * | 1/2013 | Babbitt et al. | 40/1.5 |

OTHER PUBLICATIONS

International Search Report issued in corresponding application No. PCT/AU2011/001418 mailed Jan. 11, 2012.

* cited by examiner

*Primary Examiner* — Casandra Davis
(74) *Attorney, Agent, or Firm* — Carter, DeLuca, Farrell & Schmidt LLP

(57) ABSTRACT

A medal mounting apparatus comprises a mounting plate and a backing plate. The mounting plate has at least one hole through the plate. The hole is adapted to allow a medal to be secured to the plate by a tie or stitch through the plate. The backing plate is adapted to be secured to a garment and to be releasably secured to the mounting plate such that when secured, the backing plate is spaced from the mounting plate to create a cavity between the mounting plate and the backing plate.

19 Claims, 5 Drawing Sheets

MEDAL MOUNTING APPARATUS

FIELD OF THE INVENTION

The present invention relates to a medal mounting apparatus particularly for the court mounting of medals for award recipients of honours conferred in recognition of achievement or meritorious service.

BACKGROUND OF THE INVENTION

Medals are awarded for a wide range of achievements and service. Recipients can include members of the public, emergency services, government public servants and military personnel. Awards typically comprise a metal medal hung from a colour prescribed ribbon. Often for awards that have be conferred to a recipient more than once, medal bars can be attached above the medal on the ribbon in order to visually display the additional honour.

Award recipients will often be required to wear their medals in formal and informal ceremonial activities such as state dinners, commemorations, emergency services and military parades. In order for recipients to present their awards in an order befitting the honour they are appropriately mounted for wearing. The two methods of mounting medals are swing mounted and court mounted. The present invention relates to the later of the methods, court mounting.

Mounting is typically carried out by stitching and/or adhering the ribbon of each medal to a flat backboard commonly of a cardboard or canvas material, such that the ribbons and medals are fixed in place. Vinyl or material is regularly glued to the rear of the backboard to cover ribbon and medal stitching.

As medals tarnish easily, they need to be cleaned thoroughly to stop deterioration and pitting, which is difficult when the medals are court mounted as described above. Further, as more medals are awarded they must be added to the court mount. Cleaning of the medals or the addition of new medals typically requires removing the medals from the back board, cleaning the medals and then remounting the medals on a new back board with new lengths of ribbon. This can typically be a very expensive process with the additional ribbon or cleaning requirements, in most cases having to be conducted by jewellers or medal mounting specialists. These costs can quickly escalate even further if the labour intensive procedure to remount the medals is required.

OBJECT OF THE INVENTION

It is an object of the present invention to substantially overcome or at least ameliorate one or more of the above disadvantages, or to provide a useful alternative.

SUMMARY OF THE INVENTION

In a first aspect, the present invention provides a medal mounting apparatus comprising:

- a mounting plate having at least one hole through the plate, the hole adapted to allow a medal to be secured to the plate by a tie or stitch through the plate; and
- a backing plate adapted to be secured to a garment;
- wherein the backing plate is adapted to be releasably secured to the mounting plate is such that when secured, the backing plate is spaced from the mounting plate to create a cavity between the mounting plate and the backing plate.

In a preferred embodiment, the medal mounting apparatus further comprises a spacing flange arrangement on at least one of the backing plate and the mounting plate, the spacing flange arrangement adapted to space the backing plate from the mounting plate.

Preferably, the backing plate is releasably securable to the mounting plate via the spacing flange arrangement. Further preferably, the spacing flange arrangement is provided on the mounting plate and includes a pair of upper flanges adjacent to an upper end of the mounting plate and a pair of lower flanges adjacent to a lower end of the mounting plate. More preferably, the backing plate includes a pair of recessed tabs adjacent to an upper end of the backing plate and an upwardly projecting flap adjacent to a lower end of the backing plate and wherein the recessed tabs are adapted to engage the upper flanges and the flap is adapted to engage the lower flanges when the backing plate is slidably engaged with the mounting plate.

The medal mounting apparatus preferably further comprises a customised medal ribbon, the medal ribbon having a hook secured at one end and wherein the backing plate has a slot adapted to receive the hook. Further preferably, the hook is attached to the medal ribbon by a length of elastic material such that the medal ribbon can be held in tension by stretching the elastic material in order to mount the hook in the slot.

In a preferred embodiment, the backing plate is provided with a pin for attaching the medal mounting apparatus to a garment.

Preferably, the at least one hole in the mounting plate includes a plurality of holes arranged towards the lower end of the mounting plate, the holes being arranged to allow one or more stitches to pass through the mounting plate to secure the medal at the lower end of the mounting plate.

The medal mounting apparatus preferably further comprises at least one pair of medal bar mounting holes, the holes of each pair of medal bar mounting holes being arranged towards the upper end of the mounting plate.

The mounting plate may be sized to mount a single medal or alternatively, the mounting plate may be sized to mount multiple medals side by side.

Preferably, the backing plate is adapted to have details relating to the medal recorded on an outer surface of the backing plate.

In a second aspect, the present invention provides a method of mounting a medal on a medal mounting apparatus, the method comprising:

- providing a mounting plate and a backing plate releasably securable to the mounting plate, the mounting plate having a front face, a rear face and at least one hole extending through the plate;
- threading the medal ribbon through a connector piece associated with the medal;
- wrapping a medal ribbon on the mounting plate so that the medal ribbon extends from a front face of the mounting plate around a lower end of the mounting plate, up the rear face and over an upper end of the mounting plate, partway down the front face, through the connector piece, back up the front face, over the upper end of the mounting plate and down the rear face;
- securing the medal to the mounting plate by stitching through the at least one hole in the mounting plate;
- securing the backing plate to the mounting plate.

In a preferred embodiment, the method further comprises:

- securing the medal ribbon to the front face of the mounting plate prior to wrapping the medal ribbon around the mounting plate.

Preferably, the method further comprises:

attaching an end of the medal ribbon to the backing plate after wrapping the medal ribbon around the backing plate and prior to securing the backing plate to the mounting plate.

The method may further comprise:

mounting medal bars on the mounting plate using medal bar mounting holes formed in the mounting plate.

Optionally, the method further comprises:

mounting multiple medals on the mounting plate either side by side or partially overlapping one another by repeating the method of the second aspect for each medal.

Preferably, the method further comprises:

inscribing or otherwise printing details relating to the medal on an outer surface of the backing plate.

BRIEF DESCRIPTION OF THE DRAWINGS

A preferred embodiment of the invention will now be described by way of specific example with reference to the accompanying drawings, in which.

DETAILED DESCRIPTION OF THE PREFERRED EMBODIMENTS

Figure 1:
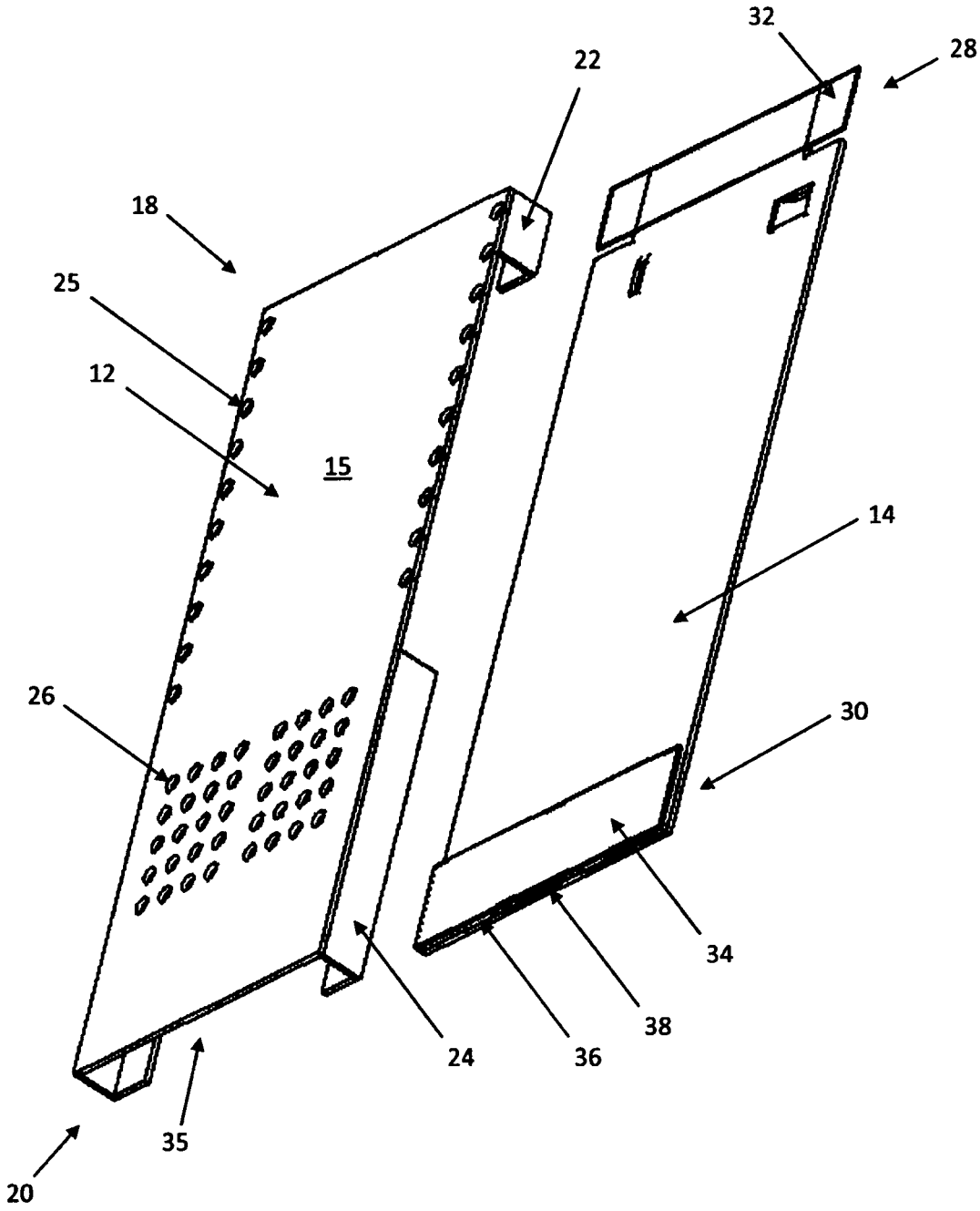
FIG. 1 is a front perspective view of a medal mounting apparatus.
Figure 2:
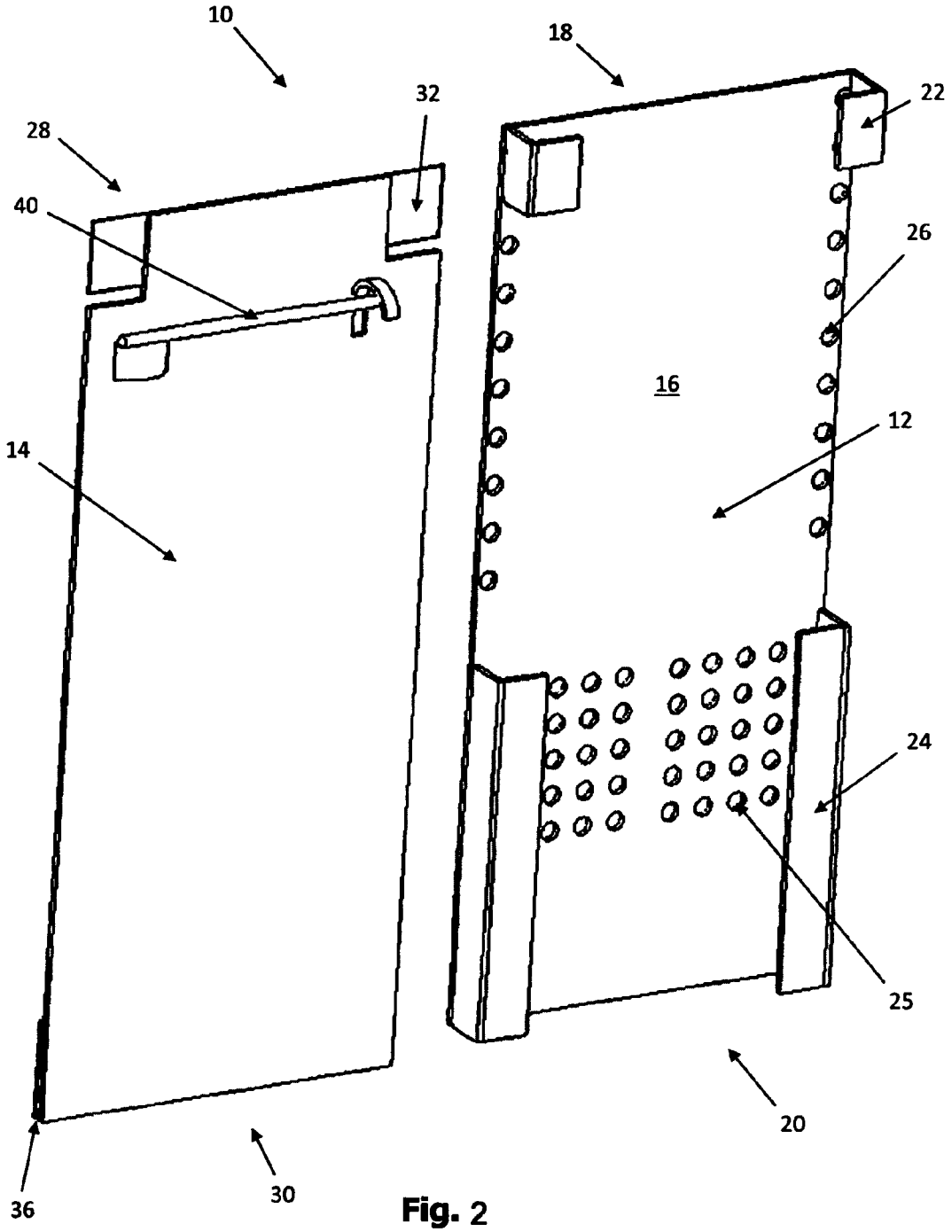
FIG. 2 is a rear perspective view of the medal mounting apparatus of FIG. 1.

Referring to FIGS. 1 and 2, a medal mounting apparatus 10 for mounting a medal to meet court mounting requirements is depicted. The medal mounting apparatus 10 comprises a mounting plate 12 and a backing plate 14 releasably mountable to the mounting plate 12.

The mounting plate 12 has a generally rectangular front face 15, an opposing rear face 16, an upper end 18 and a lower end 20. The mounting plate 12 has pair of opposing, rearwardly depending upper flanges 22 adjacent to the upper end 18 and a pair of opposing, rearwardly depending lower flanges 24 adjacent to the lower end 20. The mounting plate 12 is provided with a series of bar mounting holes 25 formed along the lateral edges of the mounting plate 12 toward the upper end 18 and a series of medal mounting holes 26 formed centrally in the mounting plate 12 toward the lower end 20.

The backing plate 14 is also generally rectangular with an upper end 28 and a lower end 30. The backing plate 14 comprises pair of recessed tabs 32 at the upper end 28 and an upwardly projecting flap 34 extending from a lower edge 36 at the lower end 30. The lower edge 36 is provided with a centrally formed slot 38. The backing plate 14 is also provided with a pin 40 for attaching the medal mounting apparatus 10 to a uniform or other article of clothing.

The backing plate 14 is designed to be slidably mounted on the mounting plate 12 by sliding the backing plate 14 upwardly adjacent to the rear face 16 of the mounting plate 12, such that the recessed tabs 32 slide under the upper flanges 22 and the upwardly projecting flap 34 slides under the lower flanges 24. This secures the backing plate 14 to the mounting plate 12 and creates a cavity 35 or hollow space between the mounting plate 12 and the backing plate 14.

The medal mounting apparatus 10 also provides the facility for recording the medal recipient's details on the outer surface of the backing plate 14. Details, such as the reason why, when and how the medal was awarded, can be recorded. These details can be inscribed in, printed on or otherwise adhered to the outer surface of the backing plate 14.

Figure 3:
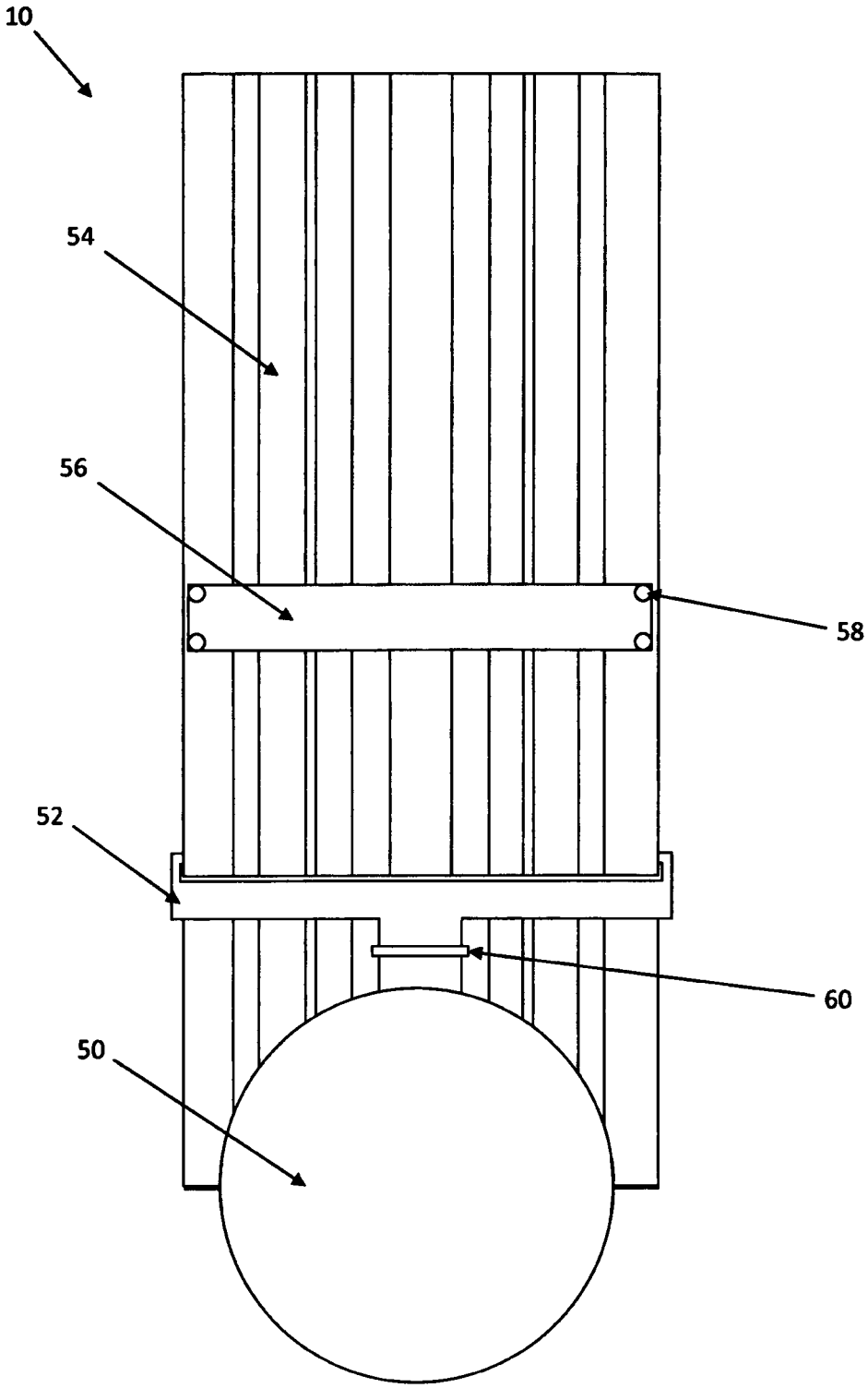
FIG. 3 is a front view of a medal mounted on the medal mounting apparatus of FIG. 1.

FIG. 3 depicts a medal 50 court mounted on the medal mounting apparatus 10. The medal 50 includes a connector piece 52 through which a medal ribbon 54 is looped. A medal bar 56 is secured on the medal mounting apparatus 10 by way of pins 58 and the medal 50 is held in place by way of a stitch 60.

Figure 4:
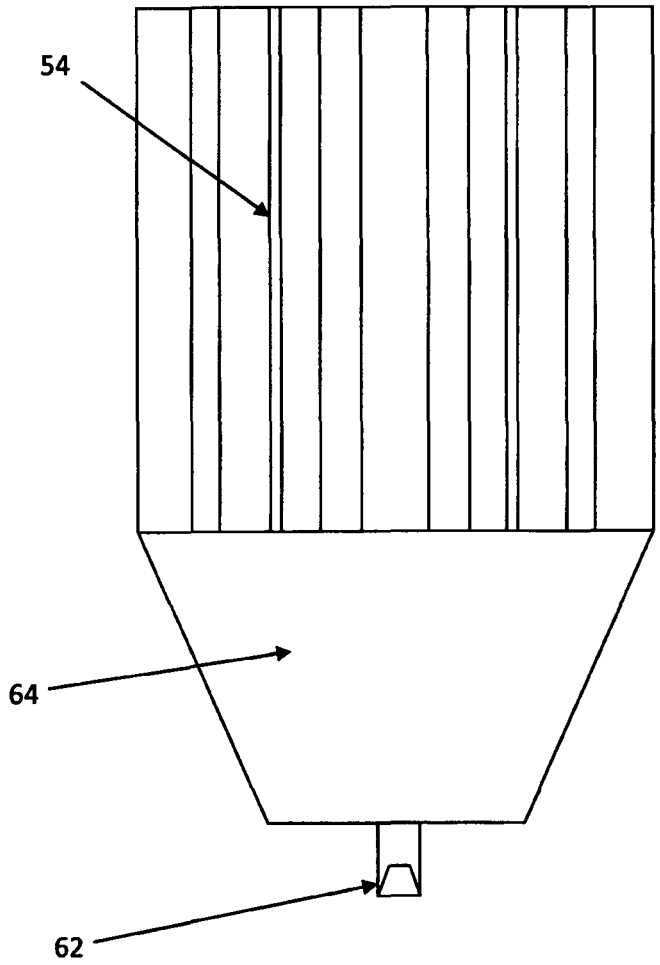
FIG. 4 is a partial view of a medal ribbon of the medal mounting apparatus of FIG. 1.

As shown in FIG. 4, the medal ribbon 54 is provided at one end with a hook 62 attached to the medal ribbon 54 by way of an elastic tab 64.

The process of mounting the medal 50 with the medal mounting apparatus will now be described.

Firstly, the hook 62 is attached to one end of the medal ribbon 54 by stitching the elastic tab 64 to the end of the medal ribbon 54. After being fed through the connector piece 52, the other end of the medal ribbon 54 is then secured to the front face 15 of the mounting plate 12 by double-sided tape, other adhesive or by stitching through the bar mounting holes 25, such that the medal ribbon 54 extends down the front face 15 of the mounting plate 12. This portion of the medal ribbon 54 can be seen behind the medal 50 in FIG. 3.

The medal ribbon 54 is then wrapped around the lower end 20 of the mounting plate 12, runs up the rear face 16 and is wrapped over the upper end 18 of the mounting plate 12.

Then the medal ribbon 54 extends partway down the front face 15 of the mounting plate 12 and after looping through the connector piece 52, is drawn upwardly and wrapped over the upper end 18 of the mounting plate 12. This portion of the medal ribbon 54 can be seen above the connector piece 52 in FIG. 3. At this stage, the medal 50 can be stitched in place by a stitch 60 passing over the connector piece 52 and through one or more of the medal mounting holes 26.

The medal ribbon 54 then runs down the rear face 16 of the mounting plate 12 and terminates in the elastic tab 64 and hook 62, with the hook 62 facing rearwardly. The backing plate 14 is then mounted by arranging the hook 62 in the slot 38 and sliding the backing plate 14 upwardly adjacent to the rear face 16 of the mounting plate 12, such that the recessed tabs 32 slide under the upper flanges 22 and the upwardly projecting flap 34 slides under the lower flanges 24. This secures the backing plate 14 to the mounting plate 12 and the medal ribbon 54 is held under tension by the elastic tab 64.

The result is a very neat and simple court mounting of the medal 50 on the medal mounting apparatus 10. The medal 50 is held securely in place by the stitch 60 and the medal ribbon 54 is maintained tightly in position by the tension in the elastic tab 64. The process of mounting the medal 50 as described above is very simple and can be easily reversed and repeated many times over, without destroying or damaging the medal ribbon 54 or mounting plate 12.

Figure 5:
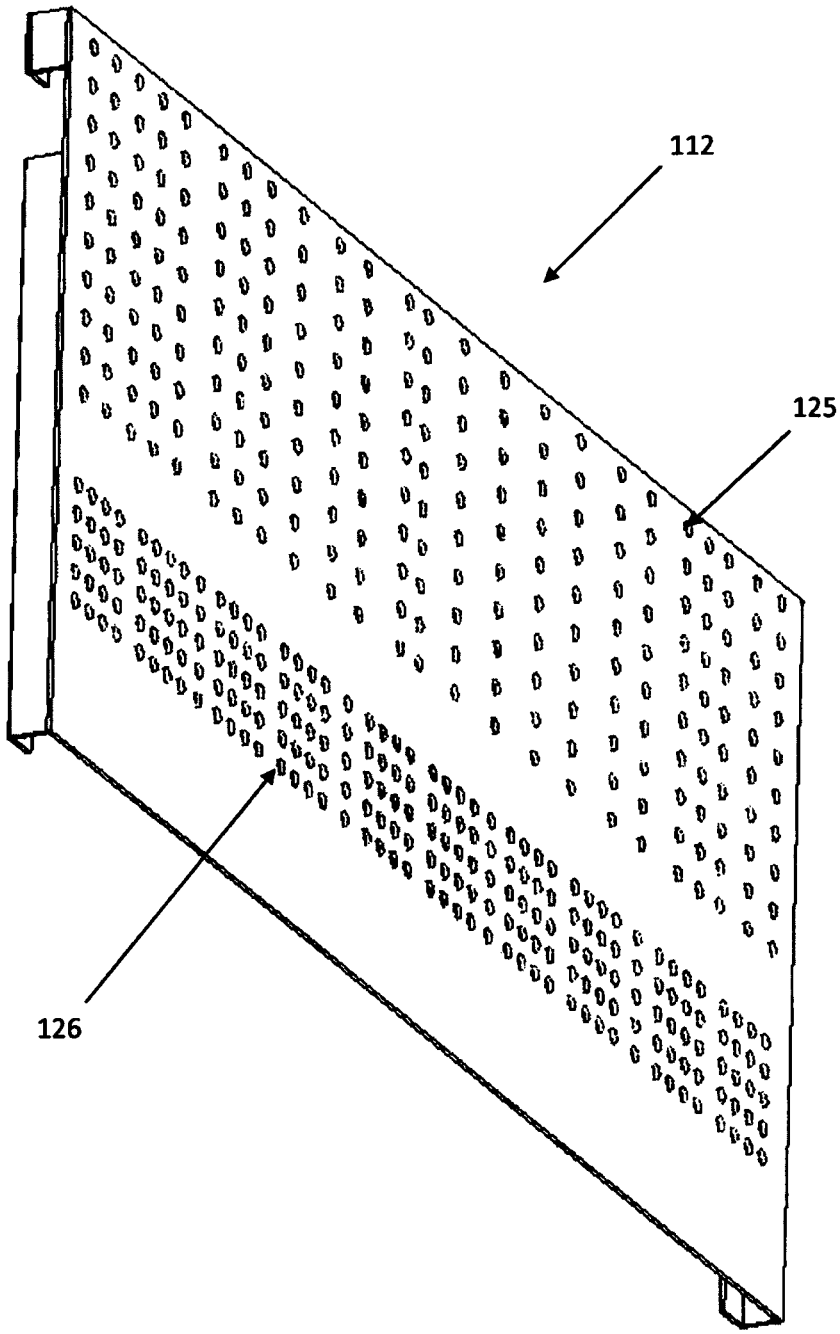
FIG. 5 is a perspective view of an alternative embodiment of a medal mounting apparatus.

Depicted in FIG. 5, is a mounting plate 112 for a medal mounting apparatus for mounting five or more medals. The mounting plate 112 includes multiple sets of bar mounting holes 125 and medal mounting holes 126 to allow medals and medal bars to be mounted in a variety of positions depending on the number of medals being mounted.

The medal mounting apparatus can be provided in a range of different widths in order to allow the mounting of multiple medals. The apparatus is typically provided in single, double, triple, quad and fivefold width variations, with a single width corresponding to the width of a standard medal ribbon, which for Australian medals is 32 mm. Each variation is typically a multiple of this standard width.

The mounting of medals on the different variations of the medal mounting apparatus follows essentially the same process as described above. The backing plate for each variation will vary in length and may have multiple slots for receiving the hooks of multiple medals. Alternatively, the hooks of additional medals can be reversed so that they attach to the base of the mounting plate instead of to the backing plate.

The medal mounting apparatus may also be used for vertical mounting by way of an elongate slot being provided along the centre of the mounting plate.

The medal mounting apparatus greatly facilitates the medal mounting process, making it much simpler and requiring much less stitching of the medal ribbons. As the medal ribbon does not need to be stitched in place, the medal and medal ribbon can be easily removed from the medal mounting apparatus without damage to the medal ribbon or medal. This allows the ribbon to be reused when the medal is remounted. The medal mounting apparatus itself can also be re-used.

Cleaning of tarnished medals is also greatly facilitated as the medal can easily be removed for cleaning and remounted without damage to the medal ribbon or medal mounting apparatus.

As the process to mount a medal does not require a great deal of skill or labour, professional medal mounting is not necessary and court mounting quality can be achieved without engaging a professional.

Although the invention has been described with reference to specific examples, it will be appreciated by those skilled in the art that the invention may be embodied in many other forms.

The invention claimed is:

1. A medal mounting apparatus comprising:

a mounting plate having at least one hole through the plate, the hole adapted to allow a medal to be secured to the plate by a tie or stitch through the plate; and a backing plate adapted to be secured to a garment;

wherein the backing plate is adapted to be releasably secured to the mounting plate such that when secured, the backing plate is spaced from the mounting plate to create a cavity between the mounting plate and the backing plate.

2. The medal mounting apparatus of claim 1, further comprising a spacing flange arrangement on at least one of the backing plate and the mounting plate, the spacing flange arrangement adapted to space the backing plate from the mounting plate.

3. The medal mounting apparatus of claim 2, wherein the backing plate is releasably securable to the mounting plate via the spacing flange arrangement.

4. The medal mounting apparatus of claim 3, wherein the spacing flange arrangement is provided on the mounting plate and includes a pair of upper flanges adjacent to an upper end of the mounting plate and a pair of lower flanges adjacent to a lower end of the mounting plate.

5. The medal mounting apparatus of claim 4, wherein the backing plate includes a pair of recessed tabs adjacent to an upper end of the backing plate and an upwardly projecting flap adjacent to a lower end of the backing plate and wherein the recessed tabs are adapted to engage the upper flanges and the flap is adapted to engage the lower flanges when the backing plate is slidably engaged with the mounting plate.

6. The medal mounting apparatus of claim 1, wherein the medal mounting apparatus further comprises a customised medal ribbon, the medal ribbon having a hook secured at one end and wherein the backing plate has a slot adapted to receive the hook.

7. The medal mounting apparatus of claim 6, wherein the hook is attached to the medal ribbon by a length of elastic material such that the medal ribbon can be held in tension by stretching the elastic material in order to mount the hook in the slot.

8. The medal mounting apparatus of claim 1, wherein the backing plate is provided with a pin for attaching the medal mounting apparatus to a garment.

9. The medal mounting apparatus of claim 1, wherein the at least one hole in the mounting plate includes a plurality of holes arranged towards a lower end of the mounting plate, the holes being arranged to allow one or more stitches to pass through the mounting plate to secure the medal at the lower end of the mounting plate.

10. The medal mounting apparatus of claim 1, further comprising at least one pair of medal bar mounting holes, the holes of each pair of medal bar mounting holes being arranged towards an upper end of the mounting plate.

11. The medal mounting apparatus of claim 1, wherein the mounting plate is sized to mount a single medal.

12. The medal mounting apparatus of claim 1, wherein the mounting plate is sized to mount multiple medals side by side.

13. The medal mounting apparatus of claim 1, wherein the backing plate is adapted to have details relating to the medal recorded on an outer surface of the backing plate.

14. A method of mounting a medal having a medal ribbon, on a medal mounting apparatus, the method comprising:

providing a mounting plate and a backing plate releasably securable to the mounting plate, the mounting plate having a front face, a rear face and at least one hole extending through the plate;

threading the medal ribbon through a connector piece associated with the medal;

wrapping the medal ribbon on the mounting plate so that the medal ribbon extends from the front face of the mounting plate around a lower end of the mounting plate, up the rear face and over an upper end of the mounting plate, partway down the front face, through the connector piece, back up the front face, over the upper end of the mounting plate and down the rear face;

securing the medal to the mounting plate by stitching through the at least one hole in the mounting plate;

securing the backing plate to the mounting plate.

15. The method of claim 14 further comprising:

securing the medal ribbon to the front face of the mounting plate prior to wrapping the medal ribbon around the mounting plate.

16. The method of claim 14 further comprising:

attaching an end of the medal ribbon to the backing plate after wrapping the medal ribbon around the backing plate and prior to securing the backing plate to the mounting plate.

17. The method of claim 14 further comprising:

mounting medal bars on the mounting plate using medal bar mounting holes formed in the mounting plate.

18. The method of claim 14 further comprising:

mounting multiple medals on the mounting plate either side by side or partially overlapping one another by repeating the method for each medal.

19. The method of claim 14 further comprising:

inscribing or otherwise printing details relating to the medal on an outer surface of the backing plate.

* * * * *